US010415437B2

(12) United States Patent
Bayrakdar

(10) Patent No.: US 10,415,437 B2
(45) Date of Patent: Sep. 17, 2019

(54) CAMSHAFT ADJUSTING DEVICE

(71) Applicant: Schaeffler Technologies AG & Co. KG, Herzogenaurach (DE)

(72) Inventor: Ali Bayrakdar, Röthenbach/Pegnitz (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 15/765,728

(22) PCT Filed: Aug. 10, 2016

(86) PCT No.: PCT/DE2016/200368
§ 371 (c)(1),
(2) Date: Apr. 4, 2018

(87) PCT Pub. No.: WO2017/071698
PCT Pub. Date: May 4, 2017

(65) Prior Publication Data

US 2018/0283231 A1 Oct. 4, 2018

(30) Foreign Application Priority Data

Oct. 28, 2015 (DE) ..... 10 2015 221 086

(51) Int. Cl.
*F01L 1/344* (2006.01)
*F01L 1/047* (2006.01)
(Continued)

(52) U.S. Cl.
CPC ..... *F01L 1/3442* (2013.01); *F01L 1/047* (2013.01); *F01L 1/24* (2013.01); *F01L 1/344* (2013.01);
(Continued)

(58) Field of Classification Search
CPC . F01L 1/3442; F01L 1/24; F01L 1/047; F01L 1/344; F01L 1/352; F01L 2001/2444; F01L 2001/34433
(Continued)

(56) References Cited

U.S. PATENT DOCUMENTS 4,096,836 A * 6/1978 Kopich ..... F01L 1/34 123/90.15
5,172,658 A * 12/1992 Hampton ..... F01L 1/34409 123/90.17
(Continued)

FOREIGN PATENT DOCUMENTS

DE 102007017514 A1 10/2008
DE 102010000047 A1 7/2010
(Continued)

OTHER PUBLICATIONS

DE-102011077020 english language machine translation.*

*Primary Examiner* — Mark A Laurenzi
*Assistant Examiner* — Wesley G Harris
(74) *Attorney, Agent, or Firm* — Matthew V. Evans

(57) ABSTRACT

Camshaft adjusting devices are disclosed. In one example, a camshaft adjusting device may include a camshaft adjuster and a camshaft. The camshaft may include a camshaft end which is configured both to receive a hydraulically actuatable camshaft adjuster and to receive an electromechanically actuatable camshaft adjuster. The camshaft end may have two different threads for receiving a bolt.

6 Claims, 2 Drawing Sheets

(51) Int. Cl.
*F01L 1/352* (2006.01)
*F01L 1/24* (2006.01)

(52) U.S. Cl.
CPC ..... *F01L 1/352* (2013.01); *F01L 2001/0473* (2013.01); *F01L 2001/2444* (2013.01); *F01L 2001/34433* (2013.01)

(58) Field of Classification Search
USPC ..... 123/90.15, 90.17, 90.18
See application file for complete search history.

(56) References Cited

U.S. PATENT DOCUMENTS 5,184,581 A * 2/1993 Aoyama ..... F01L 1/02 123/90.15
5,417,186 A * 5/1995 Elrod ..... F01L 1/02 123/90.17
2010/0218736 A1* 9/2010 Watanabe ..... F01L 1/3442 123/90.17
2011/0197839 A1* 8/2011 Yoshika ..... F01L 1/047 123/90.17
2014/0076252 A1* 3/2014 Burke ..... F01L 1/352 123/90.17
2016/0032790 A1* 2/2016 David ..... F01L 1/348 123/90.11

FOREIGN PATENT DOCUMENTS

DE 102009029389 A1 3/2011
DE 102011077020 A1 * 12/2012 ..... F01L 1/344
DE 102013003556 A1 9/2013
DE 102013207747 A1 10/2014
DE 102013016831 A1 4/2015
EP 1201886 A1 5/2002
EP 1571301 A1 9/2005

* cited by examiner

CAMSHAFT ADJUSTING DEVICE

CROSS-REFERENCE TO RELATED APPLICATIONS

This application is the U.S. National Phase of PCT Appln. No. PCT/DE2016/200368 filed Aug. 10, 2016, which claims priority to DE 102015221086.3 filed Oct. 28, 2015, the entire disclosures of which are incorporated by reference herein.

TECHNICAL FIELD

The disclosure concerns a camshaft adjusting device.

BACKGROUND

Camshaft adjusters are used in internal combustion engines to vary the timing of the combustion chamber valves, in order to be able to structure the phase relationship between a crankshaft and a camshaft variably within a defined angular range between a maximally advanced and a maximally retarded position. The adaptation of the valve timings to the actual load and rotation speed reduces fuel consumption and emissions. To this end, camshaft adjusters are integrated in a drive train via which a torque is transmitted from the crankshaft to the camshaft. This drive train may be formed for example as a V-belt, chain or sprocket drive.

In a hydraulic camshaft adjuster, the output element and the input element form one or more pairs of pressure chambers which act against each other and can be loaded with hydraulic medium. The input element and the output element are arranged coaxially. The filling and evacuation of the individual pressure chambers creates a relative movement between the input element and the output element. The spring, acting rotationally between the input element and the output element, forces the input element into an advantageous direction relative to the output element. This advantageous direction may be the same as or opposite to the twist direction.

One design of hydraulic camshaft adjuster is the vane adjuster. The vane adjuster has a stator, a rotor and a drive wheel with external toothing. The rotor is configured as an output element which can usually be connected rotationally fixedly to the camshaft. The input element contains the stator and the drive wheel. The stator and the drive wheel are connected together rotationally fixedly, or alternatively are configured integrally with each other. The rotor is coaxial to the stator and is arranged inside the stator. The rotor and the stator, with their radially extending vanes, influence oil chambers which act opposite each other, can be loaded with oil pressure and allow a relative rotation between the stator and the rotor. The vanes are formed either integrally with the rotor or stator, or are arranged as "push-fit vanes" in grooves of the rotor or stator provided to this end. Furthermore, vane adjusters have various sealing covers. The stator and the sealing cover are secured to each other via several screw connections.

Another design of hydraulic camshaft adjuster is the axial piston adjuster. Here a slider element is moved axially via oil pressure, and via oblique toothing causes a relative rotation between an input element and an output element.

A further design of camshaft adjuster is the electromechanical camshaft adjuster which has a three-shaft gear mechanism (for example a planetary gear mechanism). One of the shafts forms the input element and a second shaft forms the output element. Via the third shaft, rotational energy can be supplied to or discharged from the system by means of an actuator device, for example an electric motor or a brake. A spring may also be arranged which supports or returns the relative rotation between the input element and output element.

EP 1 571 301 A1 presents a camshaft adjusting arrangement wherein different power sources are provided for each of two camshafts.

DE 10 2010 000 047 A1 discloses a valve control device with an input rotor which rotates with a crankshaft, an output rotor which rotates with the camshaft, a planet wheel which executes a planetary movement to adjust the rotational phase between the camshaft and the crankshaft, a motor shaft which rotates for controlling the planetary movement, a cylindrical planet wheel carrier which carries the planet wheel and is connected to the motor shaft such that the planet wheel executes a planetary movement, and a lubricating device. The lubricating device has an infeed opening which emerges on a side face of the second rotor which lies axially opposite the planet wheel carrier. The infeed opening extends over an outer bearing face and an inner connecting face. Lubricant is conducted to the first rotor via the infeed opening.

DE 10 2013 003 556 A1 describes a variable valve timing control device. This has an input-side rotary component, an output-side rotary component positioned coaxially with a rotation axis of the input-side rotary component, at least one plate, a plurality of separating regions with a fluid chamber formed between the separating regions, a slider region which is fitted into the fluid chamber for relative rotation of the input-side rotary component and the output-side rotary component within a movement range thereof, a limiting mechanism for limiting a relative rotational phase, a fixing component which fixes the plate and separating region of the input-side rotary component, and a reinforcing component which is in engagement with the one of the separating regions having a contact surface, wherein the contact surface is formed to receive a contact of the slider region when the relative rotational phase is either a maximally retarded angular phase or a maximally advanced angular phase.

SUMMARY

It is an object of the disclosure to indicate a camshaft adjusting device which allows particularly simple mounting of the camshaft adjuster with a camshaft.

According to the disclosure, this object is achieved by the features described herein.

The object is achieved by a camshaft adjusting device with a camshaft adjuster and a camshaft according to the disclosure, in that the camshaft comprises a camshaft end which is designed both to receive a hydraulically actuatable camshaft adjuster and to receive an electromechanically actuatable camshaft adjuster.

This achieves that a uniformly designed camshaft end or uniformly designed connecting point for a camshaft adjuster is suitable for both a hydraulic and for an electromechanical camshaft adjuster, and prevents incorrect mounting of a camshaft adjuster on a camshaft not designed for this.

For a hydraulic camshaft adjuster, for operation a central magnet for a central valve is provided, and for an electromechanical camshaft adjuster, an electric motor. Incorrect installation of a camshaft adjuster on an incorrect camshaft end would also mean that an incorrect actuator mechanism would stand opposite the incorrectly fitted camshaft adjuster. This would entail complex dismantling. This is avoided according to the disclosure. A configuration according to the disclosure therefore advantageously also provides that the connecting points for the actuator mechanism are formed identically.

According to the disclosure, the camshaft end has two different threads for receiving a bolt. Thus advantageously, it is not critical whether a simple central bolt without valve function is used as a fastener for fixing an electromechanical camshaft adjuster, or a central valve bolt/central bolt for fixing a hydraulic camshaft adjuster. One thread is provided for each respective application. If a camshaft adjuster provided for the corresponding inlet or exhaust camshaft is mounted correctly, the corresponding unused thread remains without function.

In an embodiment, the camshaft end has an oil passage which is designed for the hydraulically actuatable camshaft adjuster. Advantageously, the oil passage may be formed by a fastener, e.g. a central bolt or a central valve bolt, and a wall of the camshaft. Alternatively, bores may be provided in the camshaft and/or in the fastener for axial oil conduction.

In a further embodiment, the camshaft end has an oil passage which is designed for the electromechanically actuatable camshaft adjuster. Advantageously, the oil passage may be formed by the fastener, e.g. a central bolt, and a wall of the camshaft. Alternatively, bores may be provided in the camshaft and/or in the fastener for axial oil conduction.

The arrangement according to the disclosure achieves the flexibility of installation of a camshaft adjuster with a specific function method on one of several camshafts.

BRIEF DESCRIPTION OF THE DRAWINGS

Exemplary embodiments of the disclosure are depicted in the figures.

The drawings show.

DETAILED DESCRIPTION

Figure 1:
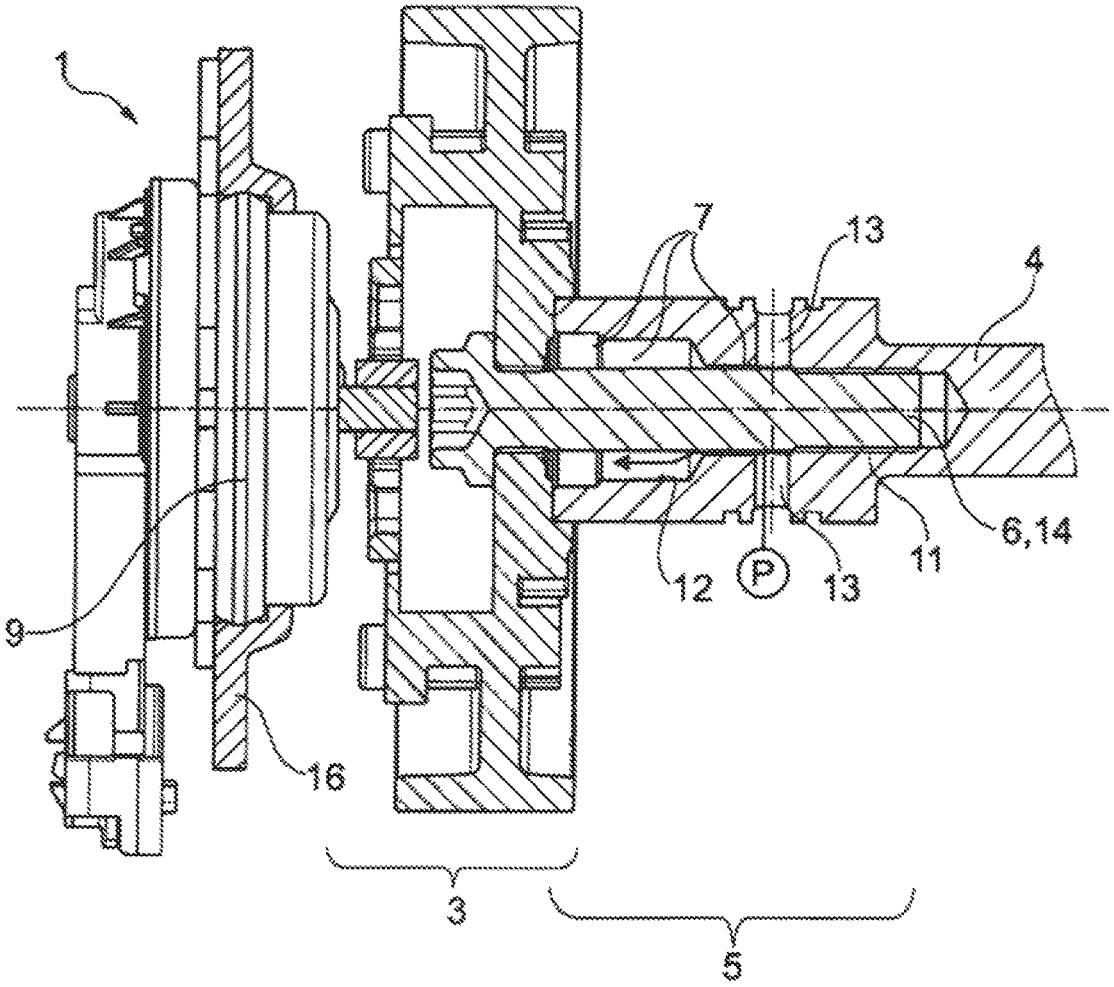
FIG. 1 is a camshaft adjusting device with an electromechanical camshaft adjuster and with a uniformly configured camshaft.

FIG. 1 shows a camshaft adjusting device 1 with an electromechanical camshaft adjuster 3 and with a uniformly designed camshaft end 5.

Figure 2:
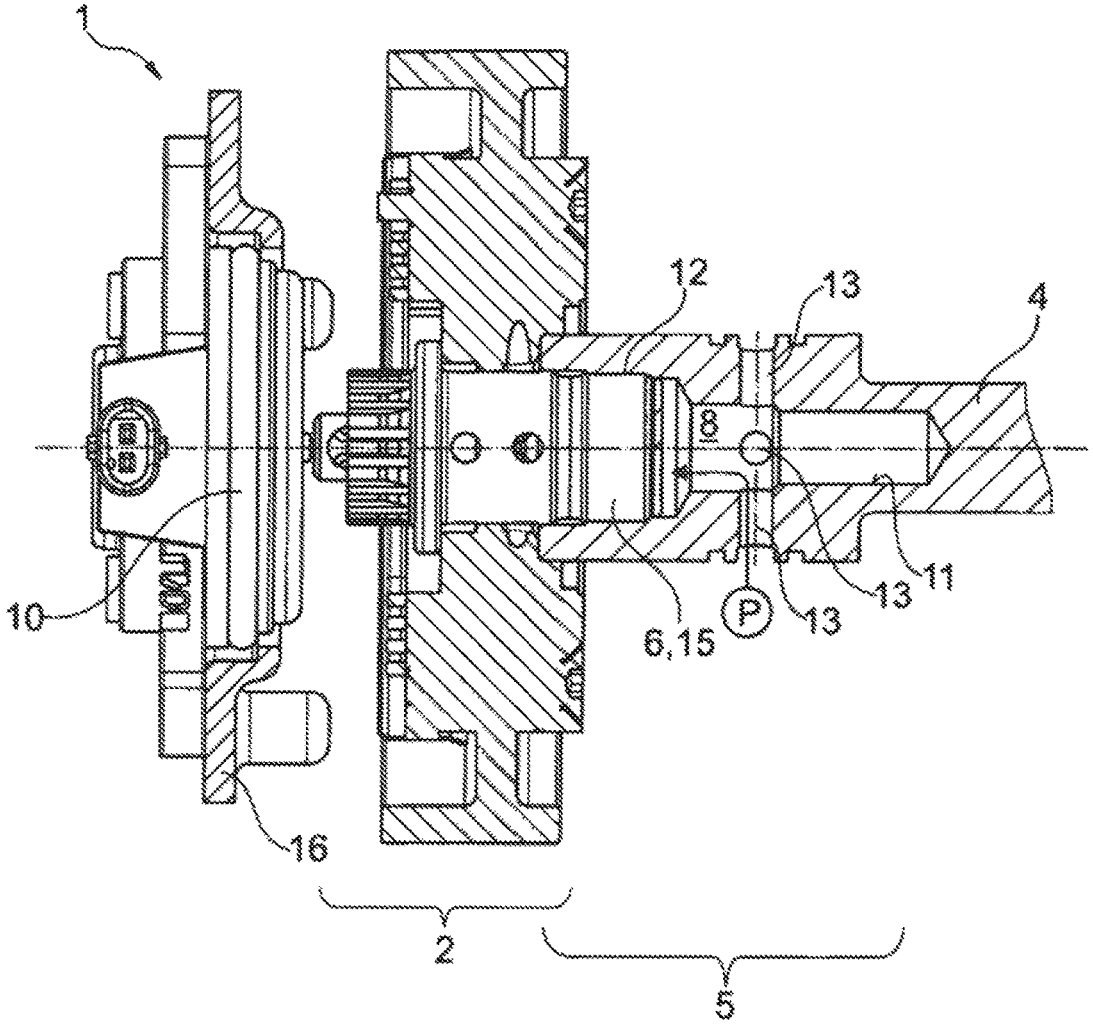
FIG. 2 is a camshaft adjusting device with a hydraulic camshaft adjuster and the uniformly configured camshaft according to FIG. 1.

FIG. 2 shows a camshaft adjusting device 1 with a hydraulic camshaft adjuster 2 and with the uniformly configured camshaft end 5 according to FIG. 1.

The difference between the camshaft adjusting device 1 in FIG. 1 and that in FIG. 2 is that an electromechanical or a hydraulic camshaft adjuster 2, 3 is attached to the camshaft end 5 of the camshaft 4. The camshaft end 4 may be configured identically in both embodiments according to the disclosure, and has two different threads 11, 12, in which the fastener formed as a bolt 6 engages. The bolt 6 is configured as a simple central bolt 14 for the electromechanical camshaft adjuster 3. For the hydraulic camshaft adjuster 2, the bolt 6 has a valve function, e.g., a central valve bolt 15. The central valve bolt 15 and the central bolt 14 each engage in the respective thread 11, 12 provided for the respective bolt design. The central bolt 14 for the electromechanical camshaft adjuster 3, together with the wall of the camshaft 4 or camshaft end 5, forms an oil passage 7 in the form of a gap. The radial bore 13 with which the oil is conveyed to the camshaft 4 is arranged between the thread 11 and the camshaft adjuster 3 in the axial direction along the rotation axis of the camshaft adjusting device 1. The oil required for lubrication of the mechanism of the electromechanical camshaft adjuster 3 is supplied axially via the oil passage 7. Because of the uniformity of the camshaft end 5, the oil passage 7 is also formed by the thread 12 suitable for the central valve bolt 15, and the bolt shank of the bolt 6.

In contrast to FIG. 1, the camshaft adjusting device 1 according to FIG. 2 is attached to the hydraulic camshaft adjuster 2 by means of a bolt 6 configured as a central valve bolt 15 on the camshaft end 5. The oil is conducted to the oil passage 8 again from the radial bore 13 into the interior of the camshaft end 5, with the difference that because of the absence of the bolt 6 suitable for the electromechanical camshaft adjuster 3, the receiving volume is significantly larger and the oil flow is supplied axially to the central valve bolt 15. The thread 11 remains a delimiting part of the oil passage 8 but is however without function with regard to fixing.

In FIG. 1, an electric motor 9 is arranged axially adjacent to the electromechanical camshaft adjuster 3 for actuating the camshaft adjusting device 1. The electric motor 9 is received by a housing part 16.

In FIG. 2, a central magnet 10 is arranged axially adjacent to the hydraulic camshaft adjuster 2 for actuating the camshaft adjusting device 1. The central magnet 10 is received by a housing part 16. Advantageously, the housing part 16 and/or the formation of the receiver for the electric motor 9 or central magnet 10 may be formed identically, so that flexibility in installation is increased.

LIST OF REFERENCE NUMERALS

| | |
|---|---|
| Camshaft adjusting device | 1 |
| Camshaft adjuster (hydraulic) | 2 |
| Camshaft adjuster (electromechanical) | 3 |
| Camshaft | 4 |
| Camshaft end | 5 |
| Bolt | 6 |
| Oil passage | 7 |
| Oil passage | 8 |
| Electric motor | 9 |
| Central magnet | 10 |
| Thread | 11 |
| Thread | 12 |
| Radial bore | 13 |
| Central bolt | 14 |
| Central valve bolt | 15 |
| Housing part | 16 |

The invention claimed is:

1. A camshaft adjusting device comprising:

a camshaft adjuster and a camshaft;

wherein the camshaft comprises: a camshaft end which is configured to receive one of a hydraulically actuatable camshaft adjuster by way of a first bolt or an electromechanically actuatable camshaft adjuster by way of a second bolt, said camshaft end comprising a first thread and a second thread for receiving said first bolt or said second bolt, respectively.

2. The camshaft adjusting device as claimed in claim 1, wherein the camshaft end has an oil passage which is configured for the hydraulically actuatable camshaft adjuster.

3. The camshaft adjusting device as claimed in claim 2, wherein the first bolt is a central bolt and the oil passage configured for the hydraulically actuatable camshaft adjuster is formed as a gap between the central bolt and a wall of the camshaft or the camshaft end.

4. The camshaft adjusting device as claimed in claim 1, wherein the camshaft end has an oil passage which is configured for the electromechanically actuatable camshaft adjuster.

5. The camshaft adjusting device as claimed in claim 4, wherein the second bolt is a central valve bolt and the oil passage configured for the electromechanically actuatable camshaft adjuster is delimited, at least in part, by a thread configured to receive the first bolt for the hydraulically actuatable camshaft adjuster.

6. A camshaft comprising a camshaft end which is configured to receive one of a hydraulically actuatable camshaft adjuster by way of a first bolt or an electromechanically actuatable camshaft adjuster by way of a second bolt, said camshaft end comprising a first thread and a second thread for receiving said first bolt or said second bolt, respectively.

* * * * *